US011204137B2

(12) United States Patent
Xu et al.

(10) Patent No.: US 11,204,137 B2
(45) Date of Patent: Dec. 21, 2021

(54) LED TUBE

(71) Applicant: LEDVANCE GmbH, Garching bei Munich (DE)

(72) Inventors: Gang Xu, Shenzhen (CN); Xiongqiang He, Shenzhen (CN); Long Chen, Shenzhen (CN)

(73) Assignee: LED VANCE GMBH, Garching Bei Munchen (DE)

( * ) Notice: Subject to any disclaimer, the term of this patent is extended or adjusted under 35 U.S.C. 154(b) by 0 days.

(21) Appl. No.: 16/843,415

(22) Filed: Apr. 8, 2020

(65) Prior Publication Data

US 2020/0326041 A1 Oct. 15, 2020

(30) Foreign Application Priority Data

Apr. 12, 2019 (CN) ..... 201910295069.4

(51) Int. Cl.

| | |
|---|---|
| ***F21K 9/278*** | (2016.01) |
| ***F21K 9/272*** | (2016.01) |
| ***H05B 45/375*** | (2020.01) |
| ***F21V 23/00*** | (2015.01) |
| ***F21V 23/06*** | (2006.01) |
| ***F21V 25/10*** | (2006.01) |
| ***F21Y 103/10*** | (2016.01) |
| ***F21Y 115/10*** | (2016.01) |

(52) U.S. Cl.

CPC ..... *F21K 9/278* (2016.08); *F21K 9/272* (2016.08); *F21V 23/006* (2013.01); *F21V 23/06* (2013.01); *F21V 25/10* (2013.01); *H05B 45/375* (2020.01); *F21Y 2103/10* (2016.08); *F21Y 2115/10* (2016.08)

(58) Field of Classification Search

None

See application file for complete search history.

(56) References Cited

U.S. PATENT DOCUMENTS

| | | | |
|---|---|---|---|
| 2018/0211847 A1 | 7/2018 | Zeng et al. | |
| 2019/0186699 A1 * | 6/2019 | Xiong | F21V 3/061 |

FOREIGN PATENT DOCUMENTS

| | | | | |
|---|---|---|---|---|
| CN | 202561685 | U | | 11/2012 |
| CN | 104279448 | A | * | 1/2015 |
| CN | 104279448 | A | | 1/2015 |
| CN | 206413213 | U | * | 8/2017 |
| CN | 206413213 | U | | 8/2017 |
| CN | 206890112 | U | | 1/2018 |
| CN | 208572480 | U | | 3/2019 |
| CN | 109595482 | A | | 4/2019 |
| WO | 2018001162 | A1 | | 4/2018 |

* cited by examiner

*Primary Examiner* — Britt D Hanley

(74) *Attorney, Agent, or Firm* — Hayes Soloway PC

(57) ABSTRACT

A light emitting diode (LED) tube includes a translucent tubular body having an inner surface, an outer surface, a first end, and a second end. The LED tube further includes a first end cap with a first pair of contact pins, arranged at the first end of the tubular body, and a second end cap with a second pair of contact pins, arranged at the second end of the tubular body, an LED light engine with a plurality of LEDs, and a driver circuit for driving the LED light engine. The driver circuit includes a first sub-circuit with at least one electronic component and a second sub-circuit with at least one electronic component.

17 Claims, 4 Drawing Sheets

LED TUBE

CROSS-REFERENCE TO RELATED APPLICATIONS

This application claims the benefit of Chinese patent application No. 201910295069.4 filed Apr. 12, 2019, which is hereby incorporated by reference herein in its entirety.

TECHNICAL FIELD

The present application generally relates to LED tubes. In particular, the present disclosure relates to so-called LED retrofit tubes, which are designed for mounting in light fixtures designed for fluorescent light tubes.

BACKGROUND

Due to high efficiency and robustness of light emitting diodes (LEDs), LED-based lamps provide an attractive alternative for traditional lamps, such as incandescent lamps or low-pressure gas discharge fluorescent lamps. However, the replacement of fluorescent tubes by LED tubes is not always straightforward especially since the electrical ballasts used in the existing fluorescent tube light fixtures are usually configured for receiving and powering low-pressure gas discharge lamps and not LED lamps. Furthermore, the electronic components required for driving LEDs take space inside the LED tubes and thus can considerably deteriorate the illumination characteristics of the LED tubes.

SUMMARY

The object of the present application is to provide an LED tube with improved illumination characteristics.

According to one embodiment, an LED tube for mounting in a light fixture is provided. The LED tube comprises a translucent tubular body having an inner surface, an outer surface, a first end, and a second end. The LED tube also comprises a first end cap with a first pair of contact pins, which is arranged at the first end of the tubular body, and a second end cap with a second pair of contact pins, which is arranged at the second end of the tubular body. The LED tube further comprises an LED light engine with a plurality of LEDs. In particular, the plurality of LEDs can be arranged as a linear LED array extending along the tubular body. The LED tube also comprises a driver circuit for driving the LED light engine. The driver circuit comprises a first sub-circuit with at least one electronic component and a second sub-circuit with at least one electronic component, wherein the at least one electronic component of the first sub-circuit is arranged at least partially inside the first end cap and the at least one electronic component of the second sub-circuit is arranged at least partially inside the second end cap.

Due to division of the driver circuit into two sub-circuits with electronic components arranged inside the first end cap and the second end cap, the both end caps can be used for receiving electrical components of the LED driver. By arranging the electrical components in the first end cap and the second end cap, the electronic components can be taken away from the path of the light emitted by the LEDs. In this way, essentially the whole surface of the tubular body can be illuminated by the LEDs. Furthermore, the so-called dark areas or areas of the tubular body which are not or not sufficiently illuminated or even covered, in particular, by labels, for covering electronic components inside the tubular body can be reduced or avoided. In this way, the overall luminous surface of the LED tubes can be increased as well.

The LED tube may comprise an LED circuit board extending inside the tubular body between the first end cap and the second end cap, wherein the first sub-circuit and the second sub-circuit are electrically connected via the LED circuit board. By connecting the first sub-circuit and the second sub-circuit via the LED circuit board, the LED driver can be easily divided without additional wiring or connectors.

The LED circuit board may comprise at least one conductive line extending along the LED circuit board, wherein the electrical connection between the first sub-circuit and the second sub-circuit is established. In particular, the at least one conductive line can be an essentially strait metallization line extending from one end of the LED circuit board to another end of the LED circuit board, which has only the function of electrically connecting the first sub-circuit with the second sub-circuit and is not otherwise electrically connected to the LED light engine.

The LED circuit board may have a front surface and back surface opposite to the front surface, wherein the plurality of LEDs is attached to the front surface of the LED circuit board and the back surface of the LED circuit board is attached, in particular by an adhesive layer, to the inner surface of the tubular body. In this configuration, the light emitted by the LEDs can spread inside the tubular body in such a way that an essentially homogeneous illumination of the tubular body can be achieved. The side of the tubular body at which the LED circuit board is attached can be placed towards the light fixture such that a dark stripe at the place of the attachment of the LED circuit board cannot influence much the overall illumination characteristics of the light fixture. The LED circuit board and/or the adhesive layer may be transparent in order to avoid or weaken the contrast of the dark stripe at the place of attachment of the LED circuit board.

In some embodiments, the LED circuit board is a flexible circuit board or flex board. Use of the flex-board as the LED circuit board can facilitate the assembly of the LED lamp, since the flexible ends of the flex-board can be bent for connecting to the first sub-circuit and the second sub-circuit. Thus, use of additional wiring can be avoided. The flex board can comprise a two-side metallization such that the flex board can be electrically contacted from both surfaces. The two-side metallization can be especially useful for easy assembling of the LED tube, since the flex board can be contacted with both sides to the first circuit board and the second circuit board.

The LED driver may comprise an EMI (electro-magnetic interference) filter connected to the first pair of contact pins. The input of the EMI filter can be connected via fuse to the first pair of contact pins. The first sub-circuit may comprise at least one component of the EMI filter. The EMI filter can reduce the electromagnetic interference for smooth functioning of the LED driver circuit when the AC mains is applied on the first pair of contact pins.

The LED driver may comprise a bridge rectifier, wherein the first sub-circuit comprises at least one component of the bridge rectifier. The at least one electrical component of the EMI filter and/or bridge rectifier can be chosen by taking into account its physical size, as well as the physical size of other electronic components of the driver, such that the electronic components can be efficiently hidden behind the first end cap and the second end cap. In particular, the electronic components can be mounted in the end caps is such a way that they are at least partially covered from direct view if viewed from a direction perpendicular to the symmetry axis of the tubular body.

The at least one electronic component of the first sub-circuit, which is mounted in the first end cap, comprises at least one inductive component and/or capacitive component at least partially covered by the first end cap. Further, the at least one electronic component of the second sub-circuit may comprise at least one inductive and/or capacitive component at least partially covered by the second end cap. In general, capacitive and inductive elements take a large portion of the whole space occupied by LED driver components. Thus, by hiding the capacitive and/or inductive elements under the end caps of the LED tube, the luminous surface of the tubular body can be efficiently increased.

The LED driver may comprise a buck converter, in particular, for stepping down the DC voltage delivered by the bridge rectifier to the level suitable for driving the LED light engine, wherein the second sub-circuit comprises at least one component of the buck converter. The buck converter may comprise a switching circuit with a high-frequency power transformer. The high-frequency power transformers take small volume and are not expensive.

In some embodiments, the LED tube comprises a first circuit board mounted inside the first end cap, wherein the at least one electronic component of the first sub-circuit is mounted on the first circuit board.

The LED tube may also comprise a second circuit board mounted inside the second end cap, wherein the at least one electronic component of the second sub-circuit is mounted on the second circuit board. Circuit boards are especially suitable for mounting a plurality of electrical components, such that the whole circuitries can be easily mounted inside the end caps.

In some embodiments, the EMI filter and the bridge rectifier are mounted on the first circuit board, and the buck converter is mounted on the second circuit board, wherein the first circuit board and the second circuit board are connected via two conductive line of the LED circuit board. This configuration is particularly suitable for dividing complete functional parts arranged at the first end and the second end, respectively, since the output of the bridge rectifier can be electrically connected to the input of the buck converter via the two conductive lines of the LED circuit board. Thus, the driver electronics can be divided into two spatially separated parts with a simple layout of the LED circuit board.

In some embodiments, the LED tube comprises a fuse connected to the second pair of contact pins such that the pins of the second pair of contact pins are electrically connected via the fuse. By providing the fuse connecting the two pins of the second pair of contacts, the LED tube can be configured for operation in light fixtures with conventional control gears (CCG).

In the following description, details are provided to describe the embodiments of the present specification. It shall be apparent to one skilled in the art, however, that the embodiments may be practiced without such details.

BRIEF DESCRIPTION OF THE DRAWINGS

Some parts of the embodiments have similar parts. The similar parts may have same names or similar part numbers. The description of one part applies by reference to another similar part, where appropriate, thereby reducing repetition of text without limiting the disclosure.

DETAILED DESCRIPTION OF THE INVENTION

Figure 1:
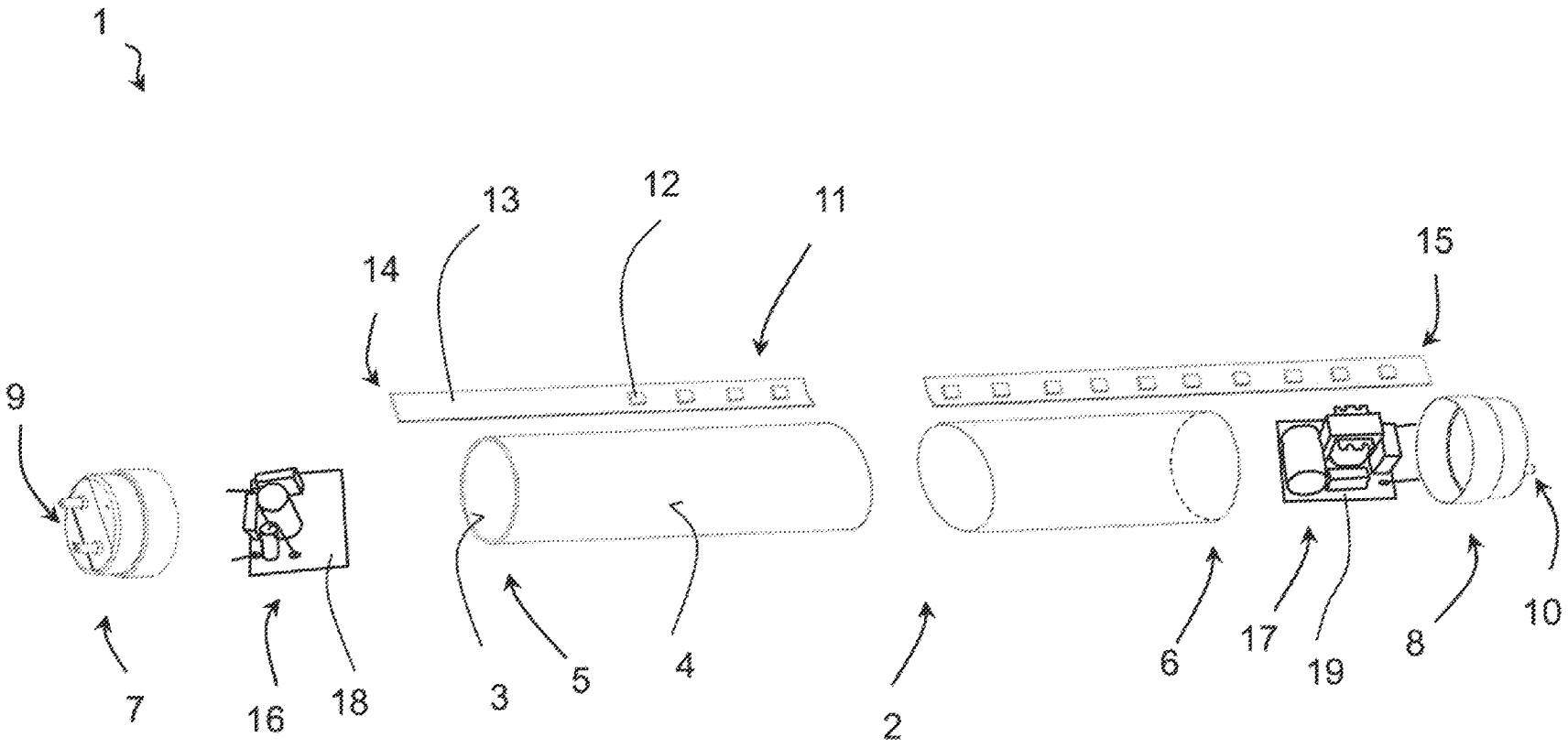
FIG. 1 shows a schematic exploded view of an LED tube according to an embodiment.

FIG. 1 shows a schematic exploded view of an LED tube 1 according to an embodiment. The LED tube 1 includes an essentially translucent tubular body 2. The tubular body 2 has an inner surface 3, an outer surface 4, a first end 5, and a second end 6.

The LED tube 1 further comprises a first end cap 7 with a first pair 9 of contact pins, arranged at the first end 5 of the tubular body 2, and a second end cap 8 with a second pair 10 of contact pins, arranged at the second end 6 of the tubular body 2.

The LED tube 1 further comprises an LED light engine 11 with LEDs 12 mounted on an LED circuit board 13 which is arranged inside the tubular body 2. The LED circuit board 13 has an elongated rectangular shape and extends along the tubular body 2 between the first end cap 7 and the second end cap 8. The LED circuit board 13 has a first end 14 arranged close to the first end 5 of the tubular body 2 and a second end 15 arranged close to the second end 6 of the tubular body 2.

The LED tube 1 also comprises an LED driver circuit for driving the LED light engine 11. The LED driver circuit comprises a first sub-circuit 16 and a second sub-circuit 17. The first sub-circuit 16 comprises electronic components mounted on a first circuit board 18 or PCB (printed circuit board), and the second sub-circuit 17 comprises electronic components mounted on a second circuit board 19.

The translucent tubular body 2 can be transparent or diffusively scattering. The tubular body 2 can be made out of glass or plastics. In some embodiments, the tubular body 2 comprises a transparent body covered with a light scattering coating for producing a diffused light.

Figure 2:
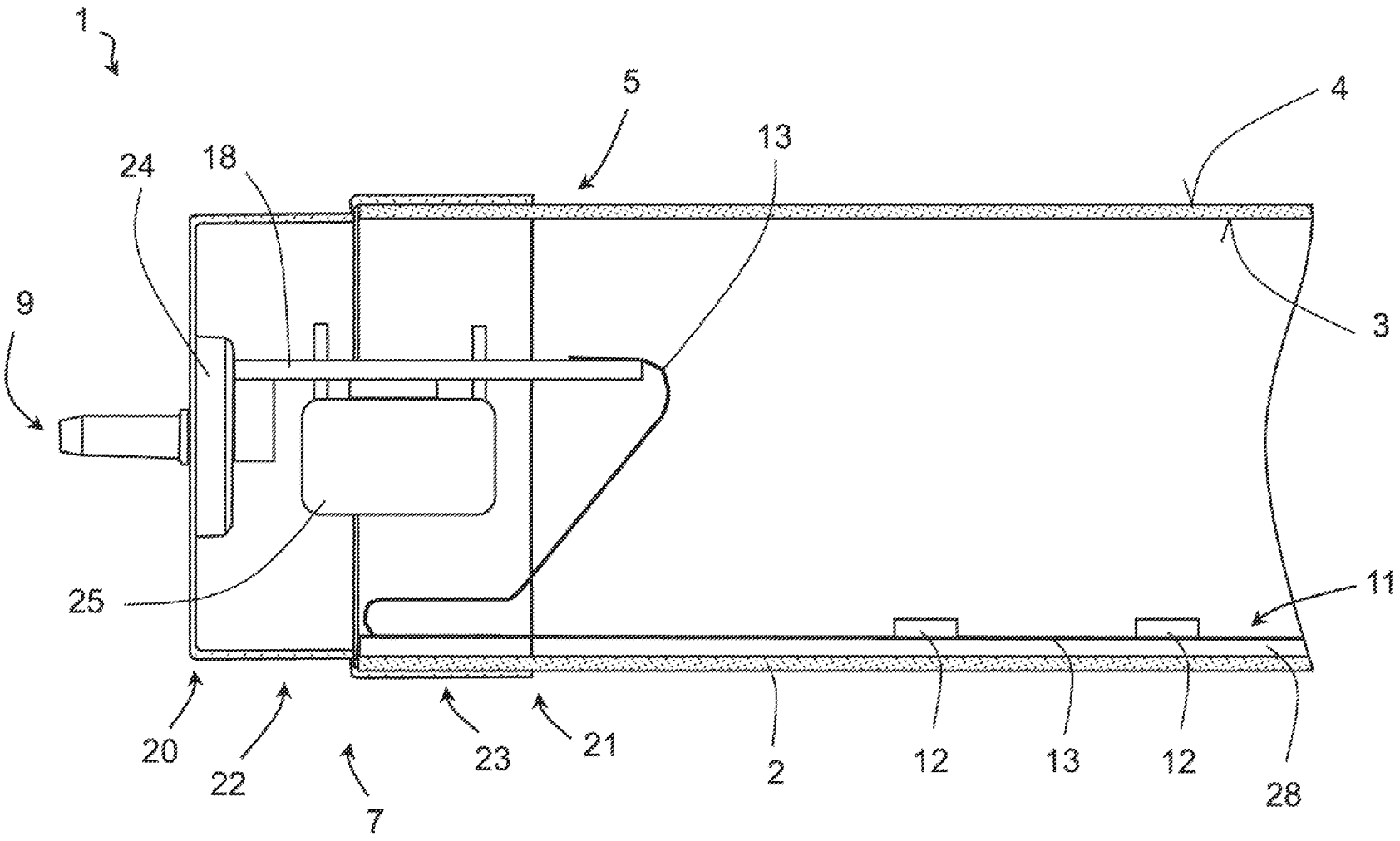
FIG. 2 shows a partial cross-sectional view of the LED tube according to FIG. 1.

FIG. 2 shows a partial cross-sectional view of the LED tube 1 according to FIG. 1. In particular, FIG. 2 shows the LED tube 1 assembly in the region of the first end cap 7. The first end cap 7 has an essentially cylindrical shape with a closed end 20 and an open end 21. The first end cap 7 comprises a first cylindrical region 22 adjacent to the closed end 20, a second cylindrical region 23 adjacent to the open end 21, and a base 24 at the closed end 20 of the first end cap 7. The first pair 9 of contact pins and the first circuit board 18 are attached to the base 24 of the first end cap 7. An electrical component 25 is mounted on the first circuit board 18 such that it is covered from direct view if viewed from a direction perpendicular to the symmetry axis of the tubular body 2. The electronic component 25 is a capacitor of an electro-magnetic interference (EMI) filter 30, see FIG. 4 below.

Figure 3:
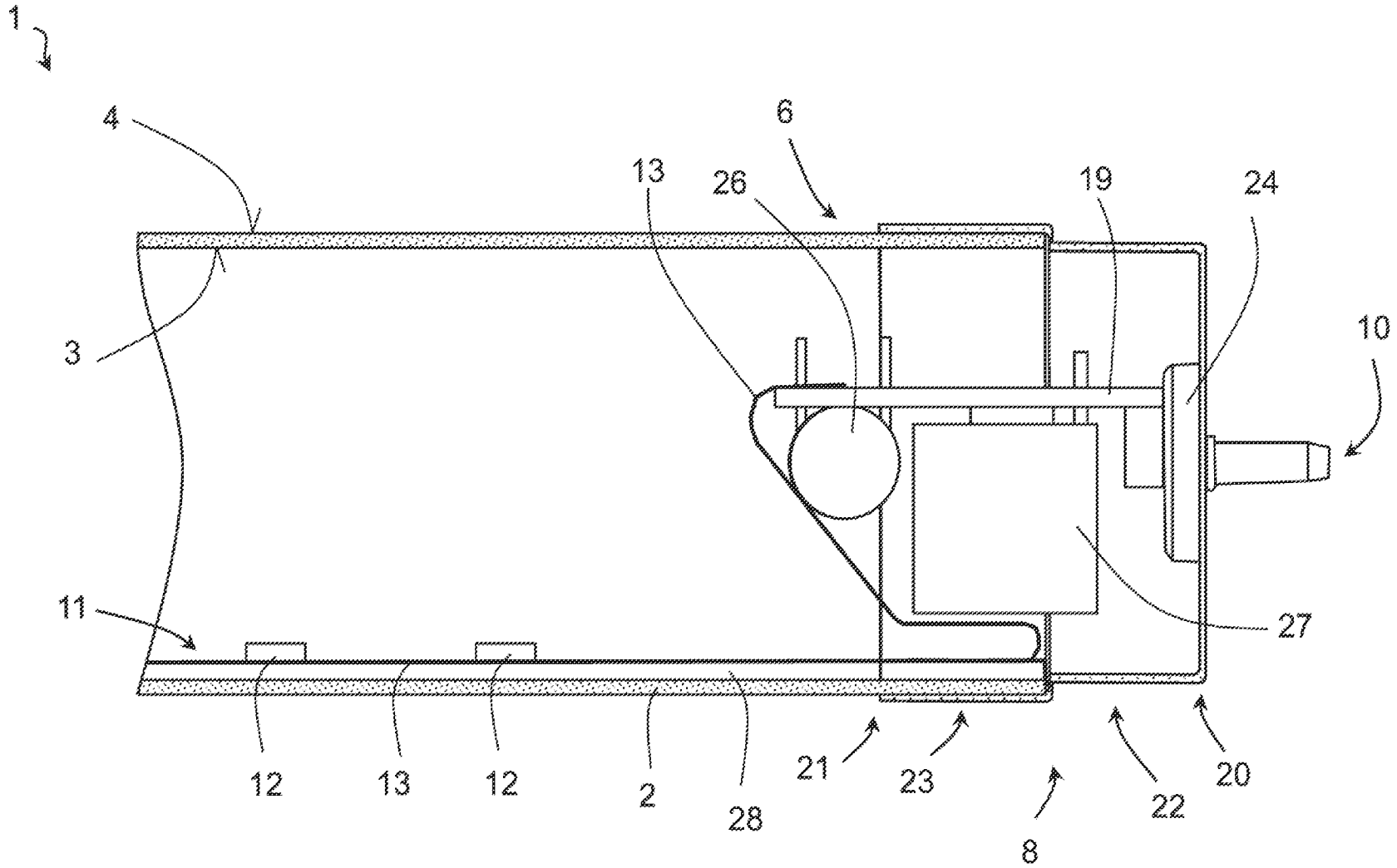
FIG. 3 shows a partial cross-sectional view of the LED tube according to FIG. 1.

FIG. 3 shows a partial cross-sectional view of the LED tube 1 according to FIG. 1. In particular, FIG. 3 shows the LED tube 1 assembly in the region of the second end cap 8. The second end cap 8 is essentially similar to the first end cap 7. In particular, the second end cap 8 has the shape of a cylinder with a closed end 20 and an open end 21. The second end cap 8 also comprises a first cylindrical region 22 adjacent to the closed end 20, a second cylindrical region 23 adjacent to the open end 21, and a base 24 at the closed end 20 of the second end cap 8. The second pair 10 of contact pins and the second circuit board 19 are attached to the base 24 of the second end cap 8. Electrical components 26 and 27 are mounted on the second circuit board 19 in such a way that the electronic component 26 is partially covered and the electronic component 27 is completely covered from a direct view if viewed from a direction perpendicular to the symmetry axis of the tubular body 2. In this embodiment, the electronic component 27 is a transformer, and the electronic component 26 is an output capacitor of a buck converter 35, see FIG. 4 below.

In this embodiment, the LED circuit board 13 is formed as a flexible circuit board or flex board. The LEDs 12 are mounted on one surface (frontside) of the flex board. The other surface opposite to the frontside backside of the LED circuit board 13 is attached with an adhesive layer 28 to the inner surface 3 of the tubular body 2. The two opposite ends of the flexible LED circuit board 13 are bent in an S-shape and connected to the first circuit board 18 and the second circuit board 19, respectively, in such a way that an electrical connection between the first sub-circuit 16, the second sub-circuit 17, and the LED light engine 11 is established. Thus, the LEDs 12 can be driven by the LED driver circuit. The S-shape bend of the flex board is especially suitable for covering the electrical components arrange close to the end caps 7 and 8 of the LED tube 1.

Figure 4:
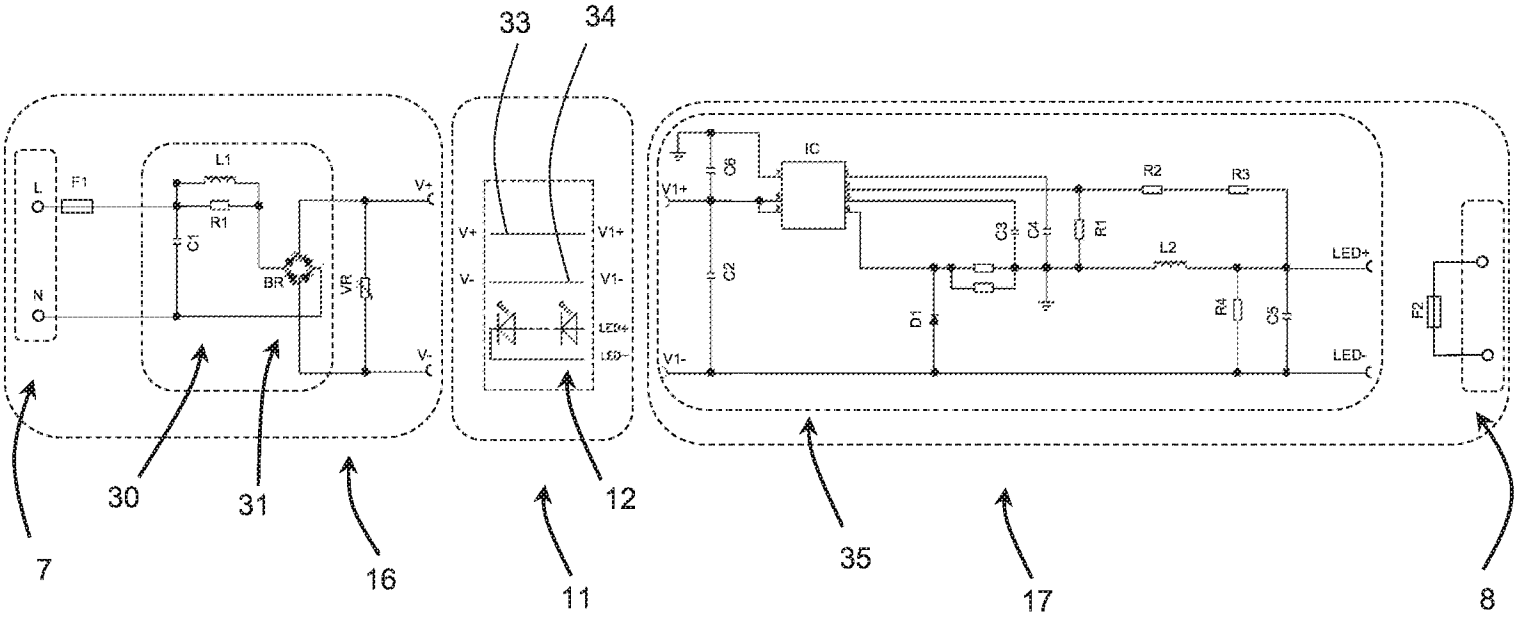
FIG. 4 shows the circuit diagram of the LED tube of FIG. 1.

FIG. 4 shows the electrical circuit diagram of the LED tube 1 of FIG. 1. For a better visualization, the electrical circuit diagram of the LED tube 1 is depicted as separate functional units indicated by dashed lines. In particular, FIG. 4 shows the first sub-circuit 16, the second sub-circuit 17, and the LED light engine 11 as separate functional units.

The first sub-circuit 16 comprises a first input contact L, a second input contact N, a first fuse F1, an electro-magnetic interference (EMI) filter 30, a bridge rectifier 31 with diodes D, a voltage stabilizer VR, a positive output contact V+, and a negative output contact V−. The EMI filter 30 comprises an input capacitor C1, a resistor R1, and an inductor L1, which are connected to form a low-pass filter for preventing high-frequency interference to reach the bridge rectifier 31.

The LED light engine 11 comprises a number of LEDs 12 and circuitry for supplying the LEDs 12 with electric current. The LEDs 12 and the circuitry are arranged on the LED circuit board 13. The LED light engine 11 comprises a positive input contact V+ and a negative input contact V−. The positive input contact V+ and the negative input contact V− are arranged at the first end 14 of the LED circuit board 13. The LED light engine 11 further comprises a positive output contact V1+, a negative output contact V1−, a positive input contact LED+, and a negative input contact LED−. The positive output contact V1+, the negative output contact V1−, the positive input contact LED+, and the negative input contact LED− are arranged at the second end 15 of the LED circuit board 13.

The circuitry of the LED light engine 11 comprises a first conductive line 33 extending along the LED circuit board 13 from the positive input contact V+ to the positive output contact V1+. The circuitry of the LED light engine 11 also comprises a second conductive line 34 extending along the LED circuit board 13 from the negative input contact V− to the negative output contact V1−.

The second sub-circuit 17 comprises a positive input contact V1+, a negative input contact V1−, a positive output contact LED+, and a negative output contact LED−. The second sub-circuit 17 also comprises a buck converter 35 integrated circuit (IC), capacitors C2, C3, C4, C4, C5, and C6, as well as resistors R1, R2, R3, R4, and a diode D1, as well as inductor L2, which are connected to form a buck converter 35 for providing a suitable DC voltage to the LED light engine 11.

In the assembled state of the LED tube 1, the positive output contact V+ of the first sub-circuit 16 is electrically connected with the positive input contact V+ of the LED light engine 11, and the negative input contact V− of the first sub-circuit 16 is electrically connected with the negative input contact V− of the LED light engine 11. Further, the positive output contact V1+ of the LED light engine 11 is electrically connected with the positive input contact V+ of the second sub-circuit 17, and the negative output contact V− of the LED light engine 11 is electrically connected with the negative input contact V− of the second sub-circuit 17. The positive output contact LED+ of the buck converter 35 is electrically connected with the positive input contact LED+ of the LED light engine 11, and the negative output contact LED− of the buck converter 35 is electrically connected with the negative input contact LED− of the LED light engine 11. The electrical connections between the first sub-circuit 16, the second sub-circuit 17, and the LED light engine 11 are not shown in FIG. 4, for the sake of simplicity.

During operation, the AC mains voltage signal is applied between the first input contact L and the second input contact N of the first sub-circuit 16. The EMI filter 30 filters the applied AC voltage signal and delivers a filtered AC signal to the bridge rectifier 31, which rectifies the filtered AC signal to a DC output voltage of the first sub-circuit 16. The DC output voltage is stabilized by the voltage stabilizer VR, which is connected between the positive output contact V+ and the negative output contact V− of the first sub-circuit 16. The voltage stabilizer VR may comprise a Zener diode for stabilizing the output voltage of the bridge rectifier 31.

The stabilized output DC voltage of the first sub-circuit 16 is transmitted over the first conductive line 33 and the second conductive line 34 of the LED light engine 11 to the second sub-circuit 17, in particular, to the positive input contact V1+ and the negative input contact V1− of the buck converter 35. The buck converter 35 is configured in such a way that the DC voltage applied between the positive input contact V1+ und negative input contact V1− of the buck converter 35 is converted into a lower DC voltage between the positive output contact LED+ und the negative output contact LED− of the buck converter 35, which are electrically connected with the positive input contact LED+ and negative input contact LED− of the LED light engine 11 for driving the LED light engine 11. Thus, the LED driver is divided into two spatially separate parts, which are arranged at the opposite ends 14, 15 of the LED light engine 11, located at the end caps 7 and 8 of the LED tube 1. In particular, due to the arrangement of the conductive lines 33 and 34 along the LED circuit board 13, the electrical connection between these two separate parts can be easily established without additional connective wires.

Due to the separation of the LED driver into two parts, both caps 7 and 8 can be used for receiving electrical components of the LED driver in such a way that the LED driver components can be effectively hidden under the both end caps 7, 8. Thus, the length of dark areas of the lamps can be reduced, and, accordingly, the effective surface of the surface can be increased.

In some embodiments, the LED tube 1 is configured as a traditional T8 LED tube with accordingly designed end caps 7, 8. The length of end caps 7 and 8 can be, for example, approximately 19 mm, while the diameters of the first cylindrical region 22 and the second cylindrical region 23 can be, for example, approximately 25.5 mm and 27.8 mm, respectively.

While at least one exemplary embodiment has been presented in the foregoing detailed description, it should be appreciated that a vast number of variations exists. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments.

What is claimed is:

1. A light emitting diode (LED) tube configured for mounting in a light fixture, the LED tube comprising:

a translucent tubular body having an inner surface, an outer surface, a first end, and a second end;

a first end cap with a first pair of contact pins, the first end cap being arranged at the first end of the tubular body;

a second end cap with a second pair of contact pins, the second end cap being arranged at the second end of the tubular body;

an LED light engine comprising:

a plurality of LEDs; and a flexible LED circuit board extending inside the tubular body between the first end cap and the second end cap; and a driver circuit for driving the LED light engine, the driver circuit comprising:

a first sub-circuit with at least one electronic component arranged at least partially inside the first end cap; and a second sub-circuit with at least one electronic component arranged at least partially inside the second end cap;

wherein the first sub-circuit and the second sub-circuit are electrically connected via the flexible LED circuit board; and wherein the flexible LED circuit board has at least one S-shaped bend formed therein such that at least one of the at least one electronic component of the first sub-circuit and the at least one electronic component of the second sub-circuit is at least partially covered by the at least one S-shaped bend from a direct view if viewed from a direction perpendicular to a symmetry axis of the tubular body.

2. The LED tube according to claim 1, wherein the LED circuit board comprises at least one conductive line extending along the LED circuit board, and wherein the electrical connection between the first sub-circuit and the second sub-circuit is established over the at least one conductive line.

3. The LED tube according to claim 1, wherein the LED circuit board has a front surface and a back surface opposite to the front surface, wherein a plurality of LEDs is attached to the front surface of the LED circuit board, and wherein the back surface of the LED circuit board is attached to the inner surface of the tubular body.

4. The LED tube according to claim 1, wherein the driver circuit comprises an electromagnetic interference (EMI) filter connected to the first pair of contact pins, and wherein the first sub-circuit comprises at least one electrical component of the EMI filter.

5. The LED tube according to claim 1, wherein the driver circuit comprises a bridge rectifier, and wherein the first sub-circuit comprises at least one electrical component of the bridge rectifier.

6. The LED tube according to claim 1, wherein the driver circuit comprises a buck converter, and wherein the second sub-circuit comprises at least one component of the buck converter.

7. The LED tube according to claim 6, wherein the buck converter comprises a high-frequency power transformer.

8. The LED tube according to claim 1, wherein the at least one electronic component of the first sub-circuit comprises at least one of an inductive component and a capacitive component at least partially covered by the first end cap.

9. The LED tube according to claim 1, wherein the at least one electronic component of the second sub-circuit comprises at least one of an inductive component and a capacitive component at least partially covered by the second end cap.

10. The LED tube according to claim 1, wherein the LED tube further comprises a first circuit board mounted inside the first end cap, and wherein the at least one electronic component of the first sub-circuit is mounted on the first circuit board.

11. The LED tube according to claim 10, wherein the LED tube further comprises a second circuit board mounted inside the second end cap, and wherein the at least one electronic component of the second sub-circuit is mounted on the second circuit board.

12. The LED tube according to claim 1, the LED tube further comprises a fuse connected to the second pair of contact pins such that the second pair of contact pins are electrically connected via the fuse.

13. The LED tube according to claim 1, wherein the LED tube is configured as an LED retrofit tube for substituting fluorescent tubes.

14. The LED tube according to claim 1, wherein the LED tube is configured for operation in a light figure with a conventional control gear (CCG).

15. The LED tube according to claim 1, wherein the at least one of the at least one electronic component of the first sub-circuit and the at least one electronic component of the second sub-circuit is completely covered from direct view if viewed from the direction perpendicular to the symmetry axis of the tubular body.

16. The LED tube according to claim 1, wherein the LED tube further comprises:

a first circuit board mounted inside the first end cap, wherein the at least one electronic component of the first sub-circuit is mounted on the first circuit board; and a second circuit board mounted inside the second end cap, wherein the at least one electronic component of the second sub-circuit is mounted on the second circuit board.

17. The LED tube according to claim 16, wherein the driver circuit comprises:

an electromagnetic interference (EMI) filter, wherein the first sub-circuit comprises at least one electrical component of the EMI filter;

a bridge rectifier, wherein the first sub-circuit comprises at least one electrical component of the bridge rectifier; and a buck converter, wherein the second sub-circuit comprises at least one component of the buck converter.

* * * * *